US008193722B2

(12) United States Patent
Dellian et al.

(10) Patent No.: US 8,193,722 B2
(45) Date of Patent: Jun. 5, 2012

(54) CIRCUIT ARRANGEMENT HAVING A TRANSFORMATION APPARATUS AND OPERATING METHOD FOR A LAMP USING A CIRCUIT ARRANGEMENT HAVING A TRANSFORMATION APPARATUS

(75) Inventors: Harald Dellian, Edling (DE); Arnulf Rupp, Oberhaching (DE); Oskar Schallmoser, Ottobrunn (DE)

(73) Assignee: Osram AG, Munich (DE)

( * ) Notice: Subject to any disclaimer, the term of this patent is extended or adjusted under 35 U.S.C. 154(b) by 607 days.

(21) Appl. No.: 12/224,290

(22) PCT Filed: Feb. 21, 2007

(86) PCT No.: PCT/EP2007/051639

§ 371 (c)(1), (2), (4) Date: Aug. 22, 2008

(87) PCT Pub. No.: WO2007/096369

PCT Pub. Date: Aug. 30, 2007

(65) Prior Publication Data

US 2009/0140662 A1 Jun. 4, 2009

(30) Foreign Application Priority Data

Feb. 23, 2006 (DE) ..... 10 2006 008 486

(51) Int. Cl.
*H05B 41/16* (2006.01)
*H05B 41/24* (2006.01)

(52) U.S. Cl. ..... 315/276; 315/246; 315/277

(58) Field of Classification Search ..... 315/255, 315/256, 268

See application file for complete search history.

(56) References Cited

U.S. PATENT DOCUMENTS

| | | | | |
|---|---|---|---|---|
| 5,241,443 | A | 8/1993 | Efantis | |
| 5,448,443 | A | 9/1995 | Muelleman | |
| 5,680,286 | A | 10/1997 | Pacholok | |
| 5,892,646 | A | 4/1999 | Parker et al. | |
| 5,972,053 | A * | 10/1999 | Hoffarth et al. | 29/25.03 |
| 6,111,732 | A * | 8/2000 | Beland | 361/42 |
| 6,504,691 | B1 * | 1/2003 | Matsui et al. | 361/38 |
| 7,417,382 | B2 * | 8/2008 | Lin | 315/225 |
| 2002/0125837 | A1 | 9/2002 | Noda et al. | |
| 2004/0121266 | A1 | 6/2004 | Lee et al. | |
| 2005/0002213 | A1 * | 1/2005 | Komori et al. | 363/56.01 |

FOREIGN PATENT DOCUMENTS

TW 393 877 B 6/2000

* cited by examiner

*Primary Examiner* — Douglas W Owens
*Assistant Examiner* — Dedei K Hammond

(57) ABSTRACT

The present invention relates to a circuit arrangement having a transformation apparatus, which has a primary side (P) and a secondary side (S), wherein the primary side and the secondary side (S) are DC-isolated from one another, wherein the primary side (P) has a terminal for a supply voltage (UE) and is connected to a first reference potential, wherein the secondary side (S) comprises a first and a second output line, which, in the normal case, are not coupled to a reference potential and which form an output terminal, at which a voltage for a load (LA) can be provided, wherein it furthermore comprises: an apparatus for tapping off a measured voltage potential (CP) on the secondary side (S); and an apparatus (10) for determining whether the measured voltage potential is in a permissible range. The invention moreover relates to an operating method for a lamp using a circuit arrangement.

15 Claims, 2 Drawing Sheets

CIRCUIT ARRANGEMENT HAVING A TRANSFORMATION APPARATUS AND OPERATING METHOD FOR A LAMP USING A CIRCUIT ARRANGEMENT HAVING A TRANSFORMATION APPARATUS

TECHNICAL FIELD

The present invention relates to a circuit arrangement having a transformation apparatus, which has a primary side and a secondary side, the primary side and the secondary side being DC-isolated from one another, the primary side having a terminal for a supply voltage and being connected to a first reference potential, the secondary side comprising a first and a second output line, which lines are normally not coupled to a reference potential and form an output terminal, at which a voltage for a load can be provided. The invention moreover relates to an operating method for a lamp using such a circuit arrangement having a transformation apparatus.

PRIOR ART

Figure 1:
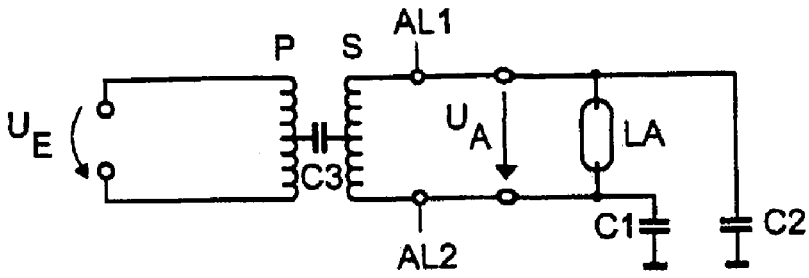
FIG 1 (Prior art)

In order to explain the problem on which the prior art is based, reference is made to FIGS. 1 and 2. FIG. 1 shows a generic circuit arrangement. In this case, the transformation apparatus, which has a primary side P and a secondary side S, is realized by a transformer. The transformation ratio is selected in the example in such a way that an output voltage $U_A$ of 5 kV is produced from an input voltage UE of 800 V. The output voltage is between a first output line AL1 and a second output line AL2. A lamp LA is connected as an example of a load. Reference is made to the fact that the secondary side is normally not connected to a reference potential. The capacitances C1 and C2 merely represent parasitic capacitances between the lamp LA and the surrounding environment. The capacitance C3 represents the parasitic coupling capacitance between the primary side P and the secondary side S. In the prior art, means are provided for detecting a short circuit between the two output lines AL1 and AL2 on the secondary side. As has been shown, however, failures nevertheless result with such circuit arrangements.

DESCRIPTION OF THE INVENTION

The object of the present invention therefore consists in developing the circuit arrangement mentioned at the outset or the operating method mentioned at the outset for a lamp using such a circuit arrangement in such a way that failures of the circuit arrangement can largely be avoided.

This object is achieved by a circuit arrangement having the features of patent claim 1 and by an operating method for a lamp using a circuit arrangement having the features of patent claim 12.

Figure 2A:
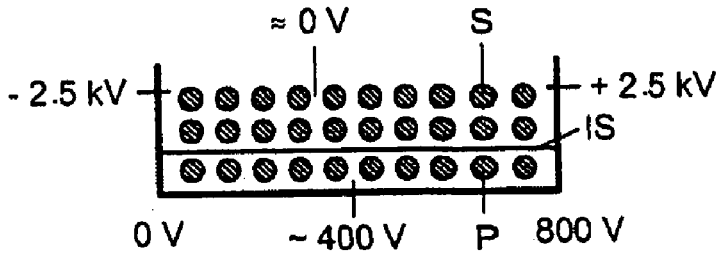
FIG 2a (Prior art)
Figure 2B:
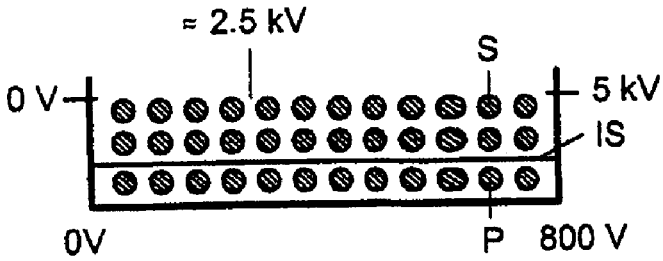
FIG 2b (Prior art)

The invention is based on the knowledge that a failure of the circuit arrangement can be brought about by the fact that one of the two output lines AL1 or AL2 is connected in the case of a fault, i.e. unintentionally, to a second reference potential, it being possible for the second reference potential to in particular represent the first reference potential or a ground connection or a 0 V line or the housing of the circuit arrangement. The corresponding voltage ratios for the example of FIG. 1 are shown in FIGS. 2*a* and 2*b*: for reasons of simplicity, the capacitance C3 (see FIG. 1) is set to 0 for the illustration in FIG. 2. FIG. 2*a* shows the ratios without one of the output lines AL1 or AL2 of the secondary side being connected to a second reference potential. In this case, the figure shows a cross section through the transformer comprising the primary and secondary sides, the cross section of the turns of the primary side and the turns, wound thereon, of the secondary side S being shown. The primary side and the secondary side are isolated from one another by an insulating layer IS. Without one of the output lines AL1 and AL2 being connected to a second reference potential, the ratios are set as illustrated in FIG. 2*a*. On the left-hand side, the reference potential of the primary side is approximately 0 V, and on the right-hand side of the primary side approximately 800 V are present, corresponding to the input voltage $U_E$. The output voltage $U_A$ on the secondary side is set without reference potential in such a way that there is approximately −2.5 kV on the left-hand side and +2.5 kV on the right-hand side. The center of the secondary side is at approximately 0 V. The potential difference between the upper and lower sides of the insulating layer IS is at most 2.5 kV (to be precise on the left-hand side of the transformer illustrated). The voltage values given are naturally instantaneous values within an AC voltage cycle.

FIG. 2*b* shows the ratios if, in a fault case which has been assumed by way of example, the output line AL2 is short-circuited with the first reference potential. The ratios on the primary side P are unchanged in comparison with the illustration in FIG. 2*a*. On the secondary side S, as a result of the short circuit with the first reference potential, a potential of 0 V is likewise formed on the left-hand side. Correspondingly, a potential of 5 kV is formed on the right-hand side of the secondary side S. The potential difference which now acts on the insulating layer IS is 4.2 kV on the right-hand side of the transformer. If the insulating layer, despite the conventional tolerances, is dimensioned for the case in FIG. 2*a*, this results in a blowout in the case of FIG. 2*b* and therefore in failure of the circuit arrangement.

Causes for the fact that at least one of the output lines AL1, AL2 is connected on the secondary side to a second reference potential may be as follows: pinch-sealing during fitting, unintentional detachment of a plug-type connection or else vibrations. Especially critical is also the situation in which there is no direct short circuit of at least one of the output lines AL1, AL2 with a second reference potential, but the second reference potential and the corresponding output line come so close to one another that a flashover may arise. In this case, arcs are produced which can easily trigger a fire. The detection of such arcs is particularly difficult since the output power of the lamps LA to be driven by a circuit arrangement according to the invention is generally at least 100 W, given an apparent power of at least 300 VA. With regard to these high powers, an arc with a power of approximately 10 W can virtually not be detected since such a power is within the conventional lamp tolerances.

The solution in accordance with the present invention consists in detecting the change in a measured voltage potential between the normal case and the fault case. The detection apparatus in this case comprises an apparatus for tapping off a measured voltage potential on the secondary side and an apparatus for determining whether the measured voltage potential is in a permissible range. In this case, the measured voltage potential can easily be related to the first reference potential. If, in the example, a potential in the center of the secondary side S is evaluated, a shift in the measured voltage potential of 0 V to 2.5 kV results (cf. FIGS. 2*a* and 2*b*).

A particularly preferred embodiment is characterized by the fact that the determination apparatus is designed to evaluate the amplitude of and/or the change over time in the measured voltage potential.

It is furthermore preferred that the measured voltage potential is a potential on the secondary side which is changed by the first output line and/or the second output line being coupled to a second reference potential. Measurement points on the secondary side at which there is the risk that, despite the coupling of the first output line and/or the second output line to a second reference potential, no change results therefore do not come into consideration.

As has already been mentioned, the second reference potential in particular represents the first reference potential or a ground connection or a 0 V line or the housing, in particular the backplate, of the circuit arrangement.

Particularly preferably, the secondary side has a measurement point, the potential at the measurement point representing the measured voltage potential, and the measurement point forming a point of symmetry. This variant provides the advantage that it can be realized with a very simple evaluation circuit since ideally a voltage potential of 0 V is normally present at the point of symmetry, while, in the case of a fault, a voltage potential with a comparatively very high absolute value can be measured there.

If, as has been mentioned, the transformation apparatus comprises a transformer, the measurement point whose potential forms the measured voltage potential particularly preferably represents the point of symmetry of the secondary side of the transformer.

For the case in which the potential tapped off at the measurement point is intended to be adjustable, the secondary side may have a voltage divider, in particular a capacitive voltage divider, which is coupled between the first output line and the second output line, the potential at the tap of the voltage divider representing the measured voltage potential.

Particularly preferably, the apparatus for tapping off the measured voltage potential comprises a capacitor. Since the input voltage $U_E$ in most cases represents an AC voltage, the measured voltage potential fluctuates with the frequency of this AC voltage and can therefore be transformed with a capacitor in a simple way. Given corresponding dimensioning of the capacitor, the voltage drop across the capacitor output is now only a low voltage, in comparison with the high voltage present across the lamp LA, and can therefore be evaluated in a risk-free manner by a user. For evaluation purposes, the signal dropping across the capacitor output can be compared with values which are stored in a table of a memory unit or with a reference voltage signal.

In an advantageous embodiment, the circuit arrangement comprises a printed circuit board, which in particular has an insulation value of CTI II or better, which corresponds to a dielectric strength of from 400 to 600 V, the capacitor being in the form of a plate capacitor and being formed by in each case one metal pad, in particular by a copper pad, on the top and the bottom side of the printed circuit board. This is made possible if, as in the example in FIG. 1, the shifts in the measured voltage potential are of an order of magnitude of more than 1 kV, in which case the capacitance of the plate capacitor is less than 50 pF, preferably less than 10 pF. In preferred applications of the circuit arrangement according to the invention, the voltage $U_A$ which can be provided during operation of the circuit arrangement at the output terminal of the circuit arrangement is more than 1 kV.

Further advantageous embodiments are given in the dependent claims.

The preferred embodiments explained in more detail in the text which follows with reference to the circuit arrangement according to the invention and the advantages thereof apply correspondingly, where applicable, to the operating method according to the invention for a lamp using such a circuit arrangement.

BRIEF DESCRIPTION OF THE DRAWING(S)

Figure 3:
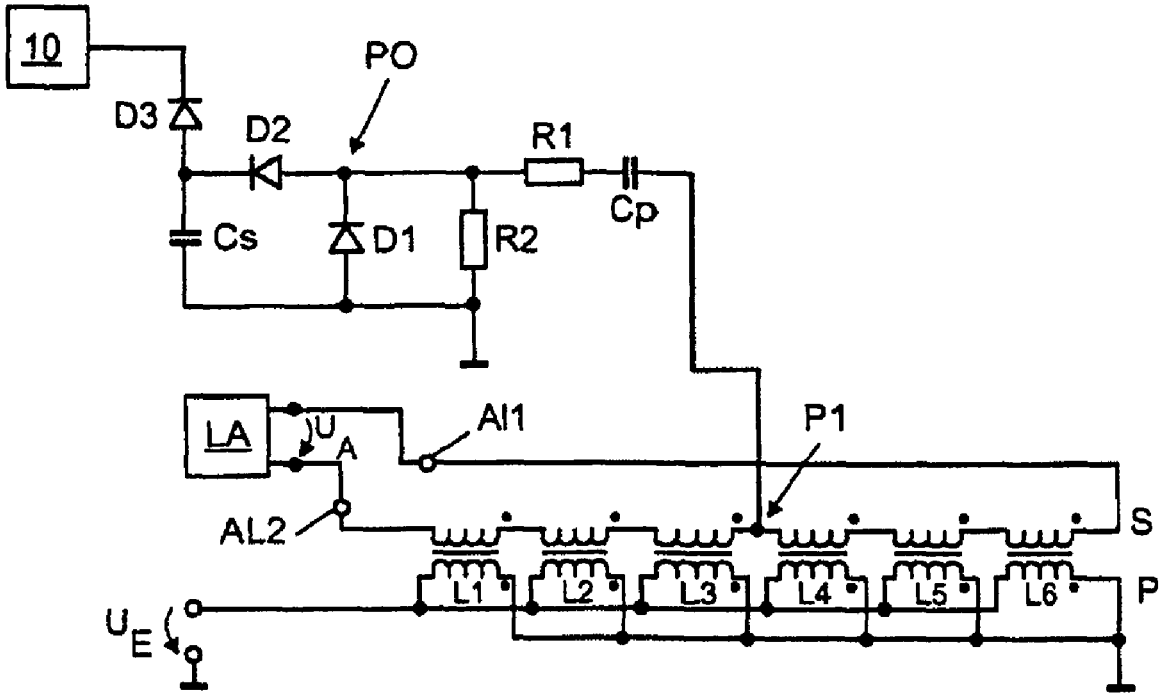

In the text which follows, an exemplary embodiment of a circuit arrangement according to the invention will now be described in more detail with reference to the attached drawings, in which:

FIG. 1 shows a schematic illustration of a circuit arrangement known from the prior art;

FIG. 2*a* shows a schematic illustration of different instantaneous voltage potentials which are formed in the normal case of operation of the circuit arrangement shown in FIG. 1;

FIG. 2*b* shows a schematic illustration of different instantaneous voltage potentials which are formed in the fault case of operation of the circuit arrangement shown in FIG. 1; and FIG. 3 shows a schematic illustration of the design of an exemplary embodiment of a circuit arrangement according to the invention.

PREFERRED EMBODIMENT OF THE INVENTION

The same reference symbols are used for components illustrated in FIG. 3 as long as they perform identical or similar functions to the corresponding components introduced with reference to FIGS. 1 and 2.

FIG. 3 shows a schematic illustration of an exemplary embodiment of a circuit arrangement according to the invention, in which an input voltage $U_E$, which is preferably a square-wave voltage, is applied to the primary side P of a transformer. The absolute value of the voltage $U_E$ is, depending on the use range, between approximately 50 and 400 V; the frequency is in the range between approximately 50 and 100 kHz. In this case the transformer comprises six modular units L1, L2, L3, L4, L5, L6, which are connected in parallel on the primary side P and are connected in series on the secondary side S. The first output line AL1 and the second output line AL2 form an output terminal, at which the output voltage $U_A$ is provided to a lamp LA.

The potential between the modular units L3 and L4 on the secondary side S of the transformer is supplied to a plate capacitor $C_P$. The nonreactive resistors R1 and R2 are used, together with a capacitor $C_P$, to set the amplitude of the signal at the point P0, the input of a charge pump, which comprises the diodes D1 and D2 and the capacitor $C_S$. A diode D3 is used for preventing feedback from an apparatus 10 for determining whether the measured voltage potential tapped off at the point P1 is in a permissible range.

The capacitor $C_P$ is in the form of a plate capacitor. An embodiment in the form of an individual component part would result in high costs and additional installation steps. An embodiment by means of a series circuit comprising a plurality of capacitors in the form SMD components would result in increased space requirement and likewise additional installation steps.

In a preferred example, the lamp LA is in the form of a flat lamp, in particular in the form of a dielectric barrier discharge lamp without mercury with a height of approximately 5 mm.

The circuit arrangement is installed on a printed circuit board, the plate capacitor $C_p$ being formed by two copper pads in each case opposite one another on the top and the bottom side of the printed circuit board, its capacitance being less than 10 pF.

What is claimed is:

1. A circuit arrangement having a transformation apparatus, which has a primary side and a secondary side, the primary side and the secondary side being DC-isolated from one another, the primary side having a terminal for a supply voltage and being connected to a first reference potential, the secondary side comprising a first output line and a second output line which form an output terminal at which a voltage for a load can be provided, comprising:

first apparatus for tapping off a measured voltage potential on only the secondary side; and second apparatus for determining whether the measured voltage potential is in a permissible range, wherein the first apparatus comprises a capacitor connected in series between the measured voltage potential and the second apparatus, wherein both first and second output lines are not DC-coupled to a reference potential during normal operation.

2. The circuit arrangement as claimed in claim 1, wherein the determination apparatus is designed to evaluate the amplitude of and/or the change over time in the measured voltage potential.

3. The circuit arrangement as claimed in claim 1, wherein the measured voltage potential is a potential on the secondary side which is changed by the first output line and/or the second output line being coupled to a second reference potential.

4. The circuit arrangement as claimed in claim 3, wherein the second reference potential represents the first reference potential, or a ground connection, or a 0 V line, or the housing, of the circuit arrangement or of a lamp.

5. The circuit arrangement as claimed in claim 1, wherein the secondary side has a measurement point, in particular a point of symmetry, the potential at the measurement point representing the measured voltage potential.

6. The circuit arrangement as claimed in claim 5, wherein the transformation apparatus comprises a transformer, the measurement point whose potential forms the measured voltage potential representing the point of symmetry of the secondary side of the transformer.

7. The circuit arrangement as claimed in claim 1, wherein the capacitor has a capacitance of less than or equal to 50 pF.

8. The circuit arrangement as claimed in claim 1, wherein the voltage which can be provided during operation of the circuit arrangement at the output terminal of the circuit arrangement is greater than or equal to 1000 V.

9. An operating method for a lamp using a circuit arrangement having a transformation apparatus, which has a primary side and a secondary side, the primary side and the secondary side being DC-isolated from one another, the primary side having a terminal for a supply voltage and being connected to a first reference potential, the secondary side comprising a first output line and a second output line which form an output terminal at which a voltage for a load can be provided, comprising:

tapping off a measured voltage potential on only the secondary side; and determining whether the measured voltage potential is in a permissible range;

wherein tapping is performed via a capacitor connected in series between the measured voltage potential and the second apparatus, wherein both first and second output lines are not DC-coupled to a reference potential during normal operation.

10. The circuit arrangement as claimed in claim 2, wherein the measured voltage potential is a potential on the secondary side which is changed by the first output line and/or the second output line being coupled to a second reference potential.

11. The circuit arrangement as claimed in claim 2, wherein the secondary side has a measurement point, in particular a point of symmetry, the potential at the measurement point representing the measured voltage potential.

12. The circuit arrangement as claimed in claim 2, wherein the voltage which can be provided during operation of the circuit arrangement at the output terminal of the circuit arrangement is greater than or equal to 1000 V.

13. The circuit arrangement as claimed in claim 1, wherein the capacitor has a capacitance of less than or equal to 10 pF.

14. The circuit arrangement as claimed in claim 1, wherein one of said first and second output lines are coupled to a second reference potential in the event of a fault.

15. The circuit arrangement as claimed in claim 14, wherein the second reference potential is identical to said first reference potential.

* * * * *